US005938493A

United States Patent [19]

Vickers

[11] Patent Number: 5,938,493

[45] Date of Patent: Aug. 17, 1999

[54] METHOD FOR INCREASING FIELD EMISSION TIP EFFICIENCY THROUGH MICRO-MILLING TECHNIQUES

[75] Inventor: Kenneth G. Vickers, Whitesboro, Tex.

[73] Assignee: Texas Instruments Incorporated, Dallas, Tex.

[21] Appl. No.: 08/768,724

[22] Filed: Dec. 18, 1996

[51] Int. Cl.[6] ..... H01J 9/00; H01J 1/02

[52] U.S. Cl. ..... 445/24; 445/25; 445/50; 313/309

[58] Field of Search ..... 445/24, 25, 29, 445/50; 313/309

[56] References Cited

U.S. PATENT DOCUMENTS

| | | | |
|---|---|---|---|
| 3,755,704 | 8/1973 | Spindt et al. | 313/309 |
| 4,857,161 | 8/1989 | Borel et al. | 204/192.26 |
| 4,857,799 | 8/1989 | Spindt et al. | 313/495 |
| 4,940,916 | 7/1990 | Borel et al. | 313/306 |
| 5,194,780 | 3/1993 | Meyer | 315/169.3 |
| 5,225,820 | 7/1993 | Clerc | 340/752 |
| 5,538,450 | 7/1996 | Vickers | 445/24 |
| 5,583,344 | 12/1996 | Mizumura et al. | 250/492.21 |
| 5,601,466 | 2/1997 | Shen et al. | 445/24 |

OTHER PUBLICATIONS

Journal of Vacuum Science & Technology B, Bozler, Carl O., Harris, Christopher T., Rabe, Steven, Rathman, Dennis D., Hollis, Mark A., and Smith, Henry I., "Arrays of gated field–emitter cones having 0.32 μm tip–to–tip spacing", pp. 629–632, vol. 12, No. 2, Mar./Apr. 1994.

Journal of Vacuum Science & Technology B, Zhirnov, V. V., and Givargizov, E.I., "Chemical vapor deposition and plasma–enhanced chemical vapor deposition carbonization of silicon microtips", pp. 633–637, vol. 12, No. 2, Mar./Apr. 1994.

Journal of Vacuum Science & Technology B, Lee, Bo, Elliott, T.S., Mazumdar, T.K., McIntyre, P. M., Pang, Y., and Trost, H. J., Knife–edge thin film field emission cathodes on (110) silicon wafers, pp. 644–647, vol. 12, No. 2, Mar./Apr. 1994.

Journal of Vacuum Science & Technology B, Pogemiller, J.E. Busta, H.H., and Zimmerman, B.J., "Gated chromium volcano emitters", pp. 680–684, vol. 12, No. 2, Mar./Apr. 1994.

*Primary Examiner*—Ponnathapura Achutamurthy
*Assistant Examiner*—P. Ponnaluri
*Attorney, Agent, or Firm*—Rose Alyssa Keagy; Robby T. Holland; Richard L. Donaldson

[57] ABSTRACT

A method of fabricating electron emission structures 30 having enhanced emission characteristics. The method comprising the steps of providing a substrate 10 having electron emission structures 5 thereon and having a gate layer 6 over the electron emission structures 5. Then modifying the electron emission structures with a focused beam to create modified electron emission structures 30 with enhanced emission efficiency.

10 Claims, 6 Drawing Sheets

METHOD FOR INCREASING FIELD EMISSION TIP EFFICIENCY THROUGH MICRO-MILLING TECHNIQUES

RELATED APPLICATIONS

This application includes subject matter which is related to U.S. patent application Ser. No. 08/761,587 "Self-Aligned Method of Micro-Machining Field Emission Display Microtips," (Texas Instruments, Docket No. TI-21247), filed Dec. 06, 1996. This application also includes subject matter which is related to U.S. Pat. No. 5,280,960 "Enhanced Field Emission Display Microtip Emissivity Structures," (Texas Instruments, Docket No. TI-23852), filed Dec. 18, 1996.

TECHNICAL FIELD OF THE INVENTION

The present invention relates generally to the manufacture of flat panel displays and, more particularly, to a method for micro-machining the microtips to enhance their emission efficiency.

BACKGROUND OF THE INVENTION

Advances in field emission display technology are disclosed in U.S. Pat. No. 3,755,704, "Field Emission Cathode Structures and Devices Utilizing Such Structures," issued Aug. 28, 1973, to C. A. Spindt et al.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued 6 Jul. 6, 1993, to Jean-Frédéric Clerc. These patents are incorporated by reference into the present application.

The Clerc ('820) patent discloses a trichromatic field emission flat panel display having a first substrate, on which are arranged a matrix of conductors. The first substrate is also called the cathode plate or the emitter plate. In one direction of the matrix, conductive columns comprising the cathode electrode support the microtips. In the other direction, above the column conductors, are perforated conductive rows comprising the grid electrode. The row and column conductors are separated by an insulating layer having apertures permitting the passage of the microtips, each intersection of a row and column corresponding to a pixel.

On a second substrate, facing the first, the display has regularly spaced, parallel conductive stripes comprising the anode electrode. The second substrate is also called the anode plate. These stripes are alternately covered by a first material luminescing in red, a second material luminescing in green, and a third material luminescing in blue, the conductive stripes covered by the same luminescent material being electrically interconnected.

The Clerc patent discloses a process for addressing a trichromatic field emission flat panel display. The process consists of successively raising each set of interconnected anode stripes periodically to a first potential which is sufficient to attract the electrons emitted by the microtips of the cathode conductors corresponding to the pixels which are to be illuminated in the color of the selected anode stripes. Those anode stripes which are not being selected are set to a potential such that the electrons emitted by the microtips are repelled or have an energy level below the threshold cathodoluminescence energy level of the luminescent materials covering those unselected anodes.

Referring initially to FIG. 1, there is shown, in cross-sectional view, a portion of an illustrative prior art field emission device in which the present invention may be incorporated. This device comprises an anode plate 1 having a cathodoluminescent phosphor coating 3 facing an emitter plate 2, the phosphor coating 3 being observed from the side opposite to its excitation.

More specifically, the field emission device of FIG. 1 comprises an anode plate 1 and an electron emitter (or cathode) plate 2. A cathode portion of emitter plate 2 includes conductors 9 formed on an insulating substrate 10, an electrically resistive layer 8 which is formed on substrate 10 and overlaying the conductors 9, and a multiplicity of electrically conductive microtips 5 formed on the resistive layer 8. In this example, the conductors 9 comprise a mesh structure, and microtip emitters 5 are configured as a matrix within the mesh spacings. Microtips 5 take the shape of cones which are formed within apertures through an electrically conductive layer 6 and an insulating layer 7.

A gate electrode comprises the layer of the electrically conductive material 6 which is deposited on the insulating layer 7. The thicknesses of gate electrode layer 6 and insulating layer 7 are chosen in such a way that the apex of each microtip 5 is substantially level with the electrically conductive gate electrode layer 6. Conductive layer 6 may be in the form of a continuous layer across the surface of substrate 10. Alternatively, as described in the Borel '161 patent, it may comprise conductive bands across the surface of substrate 10.

Anode plate 1 comprises a transparent, electrically conductive film 12 deposited on a transparent planar support 13, such as glass, which is positioned facing gate electrode 6 and parallel thereto, the conductive film 12 being deposited on the surface of the glass support 13 directly facing gate electrode 6. Conductive film 12 may be in the form of a continuous layer across the surface of the glass support 13; alternatively, it may be in the form of electrically isolated stripes comprising three series of parallel conductive bands across the surface of the glass support 13, as shown in FIG. 1 and as taught in U.S. Pat. No. 5,225,820, to Clerc. By way of example, a suitable material for use as conductive film 12 may be indium-tin-oxide (ITO), which is substantially optically transparent and electrically conductive. Anode plate 1 also comprises a cathodoluminescent phosphor coating 3, deposited over conductive film 12 so as to be directly facing and immediately adjacent gate electrode 6. In the Clerc patent, the conductive bands of each series are covered with a particulate phosphor coating which luminesces in one of the three primary colors, red, blue and green, labeled $3_R$, $3_B$, $3_G$ respectfully.

Selected groupings of microtip emitters 5 of the above-described structure are energized by applying a negative potential to cathode electrode 9 relative to the gate electrode 6, via voltage supply 15, thereby inducing an electric field which draws electrons from the apexes of microtips 5. The potential between cathode electrode 9 and gate electrode 6 is approximately 70–100 volts. The emitted electrons are accelerated toward the anode plate 1 which is positively biased by the application of a substantially larger positive voltage from voltage supply 11 coupled between the cathode electrode 9 and conductive film 12 functioning as the anode electrode. The potential between cathode electrode 9 and anode electrode 12 is approximately 300–1000 volts. Energy from the electrons attracted to the anode conductive film 12 is transferred to particles of the phosphor coating 3, resulting in luminescence. The electron charge is transferred from phosphor coating 3 to conductive film 12, completing the electrical circuit to voltage supply 11. Charge can also be transferred by secondary electron emission. The image created by the phosphor stripes is observed from the anode side which is opposite to the phosphor excitation, as indicated in FIG. 1.

The process of producing each frame of a display using a typical trichromatic field emission display includes (1) applying an accelerating potential to the red anode stripes while sequentially addressing the gate electrodes (row lines) with the corresponding red video data for that frame applied to the cathode electrodes (column lines); (2) switching the accelerating potential to the green anode stripes while sequentially addressing the rows lines for a second time with the corresponding green video data for that frame applied to the column lines; and (3) switching the accelerating potential to the blue anode stripes while sequentially addressing the row lines for a third time with the corresponding blue video data for that frame applied to the column lines. This process is repeated for each display frame.

It is to be noted and understood that true scaling information is not intended to be conveyed by the relative sizes and positioning of the elements of anode plate 1 and the elements of emitter plate 2 as depicted in FIG. 1. For example, in a typical FED shown in FIG. 1 there are approximately one hundred arrays 4, of microtips per display pixel, and there are three color stripes $3_R$, $3_B$, $3_G$ per display pixel. Furthermore, phosphor coating 3 may not be a dense coating, but instead be comprised of an arrangement of phosphor particles which have adhered to conductors 12.

The conventional process for forming the microtips in the emitter plate of the flat panel display is taught by the Spindt et al. ('704) patent. This process involves forming a sacrificial layer, called a lift-off layer, on the surface of the gate using low angle evaporation techniques well known in the industry. The lift-off layer is illustratively nickel. The microtips are formed by evaporation, at a normal angle, of the tip metal into the holes formed in the gate metal and underlying insulator material. The tip metal is illustratively molybdenum. The superfluous tip metal located on top of the lift-off layer, and the lift-off layer are then dissolved by an electrochemical process which then exposes the gate metal and the microtips.

Many techniques have been proposed for enhancing microtip emission efficiency. Such techniques include 1) interferometric lithography, as described in *Journal of Vacuum Science & Technology B*, Bozler, Carl O., Harris, Christopher T., Rabe, Steven, Rathman, Dennis D., Hollis, Mark A., and Smith, Henry I., "Arrays of gated field-emitter cones having 0.32 $\mu$m tip-to-tip spacing," pp.629–632, Volume 12, Number 2, March/April 1994; 2) application of tip surface coatings, as described in *Journal of Vacuum Science & Technology B*, Zhirnov, V. V., and Givargizov, E. I., "Chemical vapor deposition and plasma-enhanced chemical vapor deposition carbonization of silicon microtips," pp.633–637, Volume 12, Number 2, March/April 1994; and 3) changing the shape of the electron emitter surface, as described in *Journal of Vacuum Science & Technology B*, Lee, Bo, Elliott, T. S., Mazumdar, T. K., McIntyre, P. M., Pang, Y., and Trost, H. J., "Knife-edge thin film field emission cathodes on (110) silicon wafers," pp.644–647, Volume 12, Number 2, March/April 1994, and also described in *Journal of Vacuum Science & Technology B*, Pogemiller, J. E. Busta, H. H., and Zimmerman, B. J., "Gated chromium volcano emitters," pp.680–684, Volume 12, Number 2, March/April 1994, all incorporated herein by reference.

It is desirable to achieve the highest possible emission efficiency for field emission displays through enhancing microtip emission efficiency. However, there is a maximum microtip emission efficiency which can be achieved for each of the fabrication techniques taught in the articles listed above. There exists a need for a manufacturing technique which further increases the emission efficiency of any emission structure after its initial fabrication by creating microtips with radii smaller than current fabrication limits.

SUMMARY OF THE INVENTION

In accordance with the principles of the present invention, there is disclosed herein a method of fabricating electron emission structures having enhanced emission characteristics. The method comprising the steps of providing a substrate having electron emission structures thereon and having a gate layer over the electron emission structures. Then modifying the electron emission structures with a focused beam.

The methods disclosed herein for forming the enhanced emission microtips overcome limitations and disadvantages of the prior art display manufacturing methods. Specifically, this disclosed process can be used to modify microtips of any shape and material composition. Modifying the microtips to further reduce the radii of the sub-tips below microtip fabrication limits further improves the emission efficiency of the microtips. In addition, the advantageously described process for modifying the microtips is well understood; therefore, the microtips can be modified to realize enhanced emission efficiency without the time and expense of developing new manufacturing techniques.

BRIEF DESCRIPTION OF THE DRAWING

The foregoing features of the present invention may be more fully understood from the following detailed description, read in conjunction with the accompanying drawings, wherein.

DESCRIPTION OF THE PREFERRED EMBODIMENT

Figure 1:
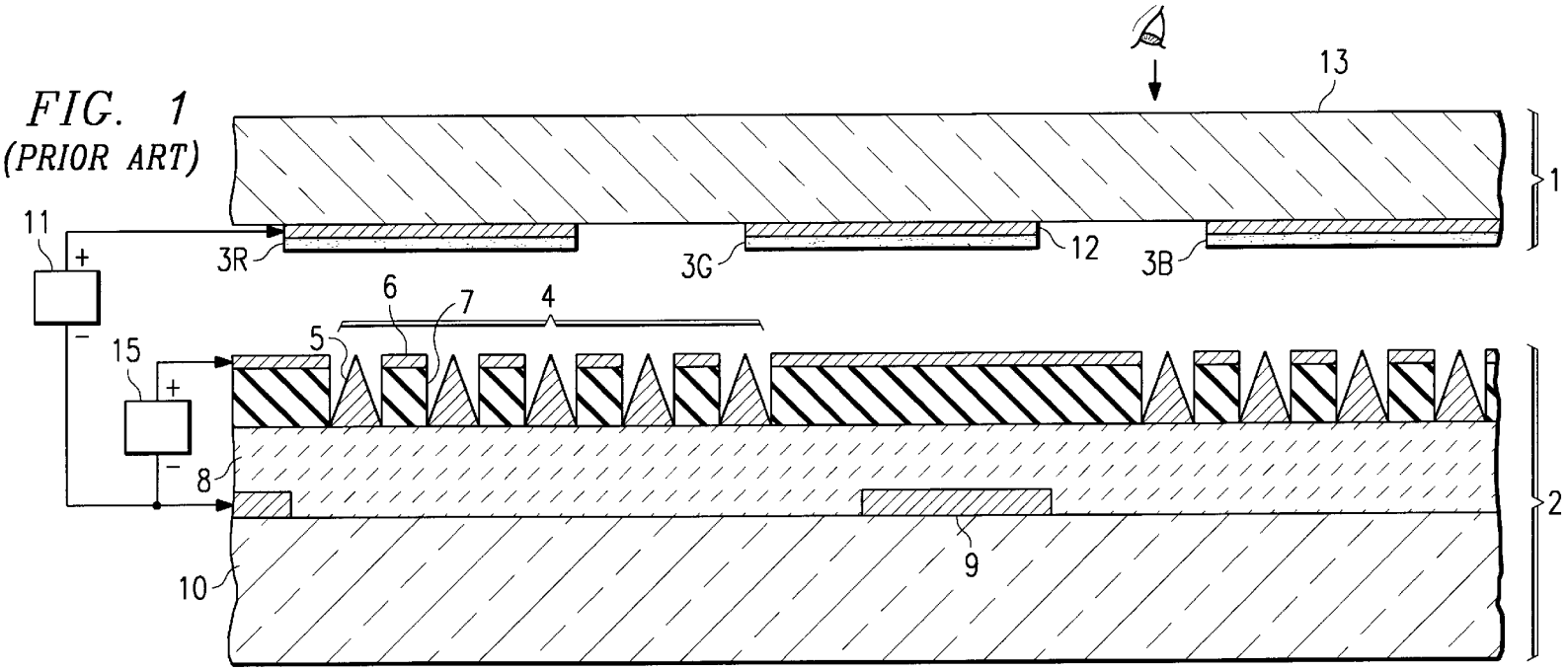
FIG. 1 (PRIOR ART)
FIG. 1 is a cross-sectional view of a portion of a prior art field emission flat panel display device.
Figure 2:
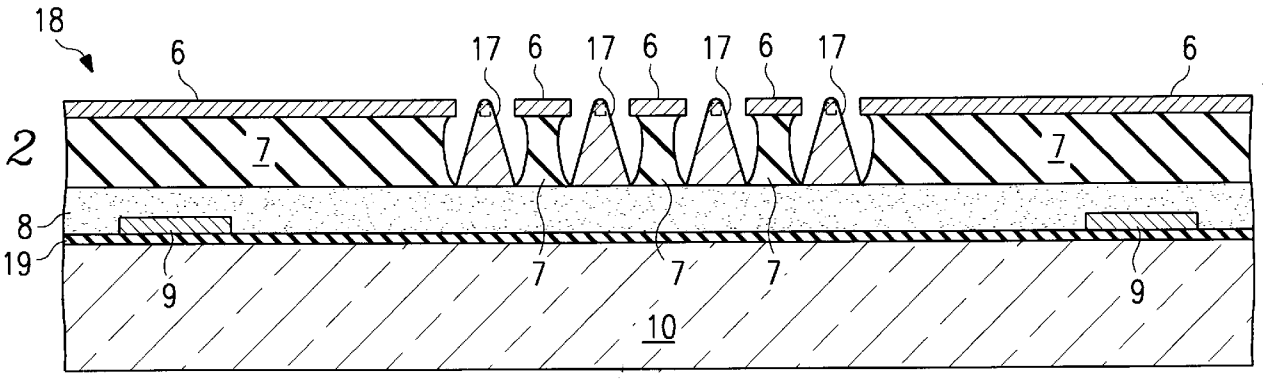
FIG. 2 is a cross-sectional view of a portion of an illustrative cathode plate fabricated in accordance with the present invention.

Referring initially to FIG. 2, there is shown, in cross-sectional view, a portion of an illustrative cathode plate fabricated in accordance with the present invention. It is to be noted and understood that true scaling information is not intended to be conveyed by the relative sizes and positioning of the elements. The illustrative cathode plate 18 of FIG. 2 includes many elements which are substantially identical to the elements of the prior art cathode plate 2 of FIG. 1. The elements of FIG. 2 which are substantially identical to the corresponding elements of the cathode plate 2 of FIG. 1 are numbered the same as the corresponding elements of FIG. 1. The primary difference between cathode plate 18 of FIG. 2 and the cathode plate 2 of FIG. 1 is the structure of the microtips 17 of FIG. 2 versus the structure of the microtips 5 of FIG. 1. The structure of microtips 17 is discussed in more detail below. An optional thin insulating layer 19 is also shown in FIG. 2.

The method of fabricating an emitter plate for use in a field emission flat panel display device in accordance with the principles of the present invention comprises the following steps, considered in relation to FIGS. 3 through 11. The elements of FIGS. 3 through 16 which are numbered the same as elements of FIG. 2 are substantially identical to those elements of FIG. 2. The widths and thicknesses of the various layers and elements of FIGS. 3 through 16 are exaggerated and distorted, and no true scaling information should be perceived therefrom.

Figure 3:
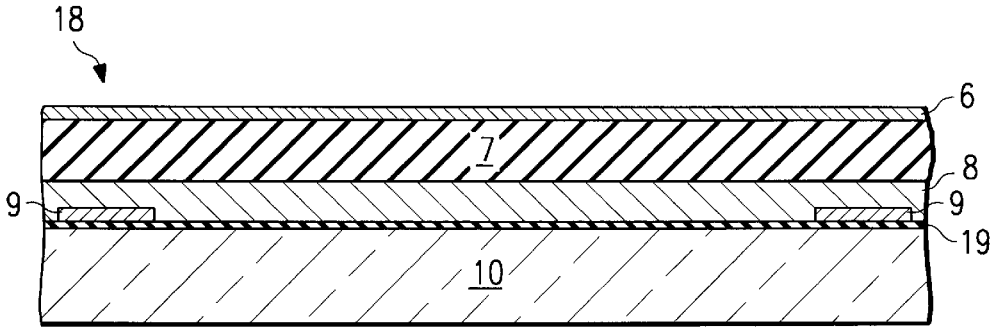
FIGS. 3 through 11 illustrate steps in a process for fabricating the cathode plate in accordance with the present invention.

The initial manufacturing steps of cathode plate 18 which follow are well known in the art (i.e. Spindt '704 and Meyer '780). Referring initially to FIG. 3, an insulating glass substrate 10 may first be coated with a thin insulating layer 19. Illustratively, the optional insulating layer 19 is $SiO_2$, which may be sputter deposited to a thickness of 50 nm. Conductive layer 9, which may typically comprise aluminum, molybdenum, chromium, or niobium, is deposited by either evaporation or sputtering over insulating layer 19 to a thickness of approximately 100–500 nm. A patterned mask and photoresist may then be used to form conductive layer 9 into a mesh structure as disclosed in the Meyer ('780) patent. Next, a resistive layer 8 is added by sputtering amorphous silicon over the cathode plate 18 to a thickness of approximately 500–2000 nm; alternatively the amorphous silicon may be deposited by a chemical vapor deposition process.

Next, insulating layer 7, which is illustratively $SiO_2$, is deposited by either a sputtered or a chemical vapor deposition technique over resistive layer 8 to a thickness of approximately 1.0 $\mu$. The gate electrode 6, which may typically comprise niobium, is then deposited by either evaporation or sputtering over insulating layer 7 to a thickness of approximately 0.2 to 0.4 $\mu$.

Figure 4:
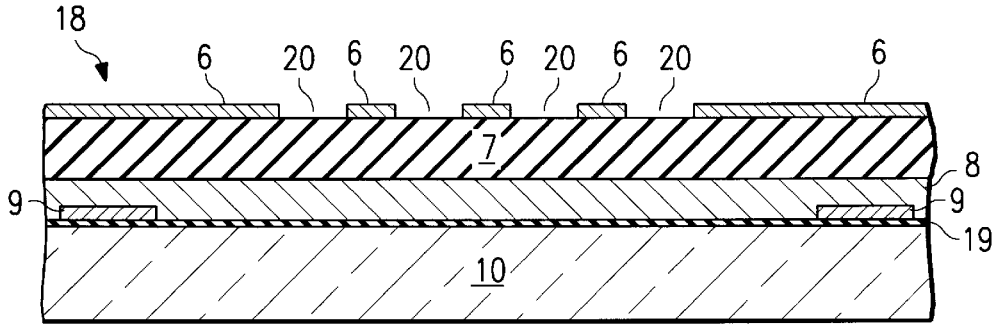

The Borel et al. ('161) patent discloses an etching process for creating the apertures in the gate electrode material coating 6 and the insulating layer 7. The described process includes a reactive ion etching of conductive coating 6 using a sulfur hexaflouride ($SF_6$) plasma to form apertures 20. The result, as shown in FIG. 4 is illustratively n×m (i.e. 4×4) apertures 20, at 3 $\mu$ aperture pitches and 25 $\mu$ aperture array pitches. The Borel et al. ('161) patent specifies that holes 20 made in the conductive coating 6 should have a diameter of 1.3±1 $\mu$. The diameter of hole 20 through conductive coating 6 is important because it affects the final form of the microtip 17.

Figure 5:
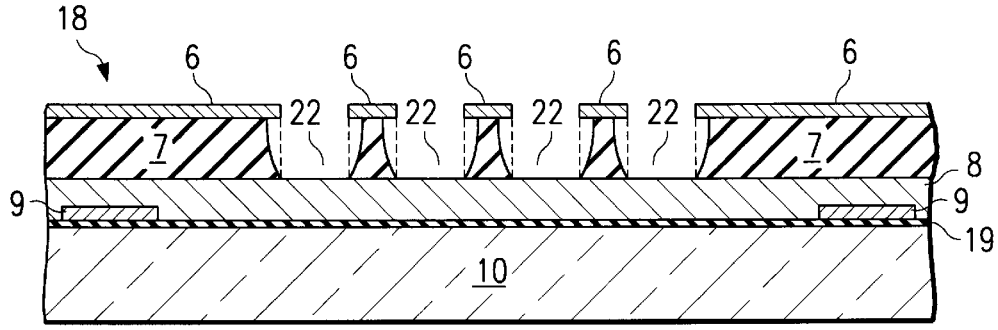

The reactive ion etching of conductive coating 6 also etches insulating layer 7, as indicated by the dashed lines in FIG. 5. Next, the insulating layer 7 is undercut by chemical etching, e.g., by immersing the structure in a hydrofluoric acid and ammonium fluoride etching solution. As shown in FIG. 5, this process results in a plurality of arrays of cavities 22 in respective concentric alignment with, and located beneath, the former apertures 20.

Figure 6:
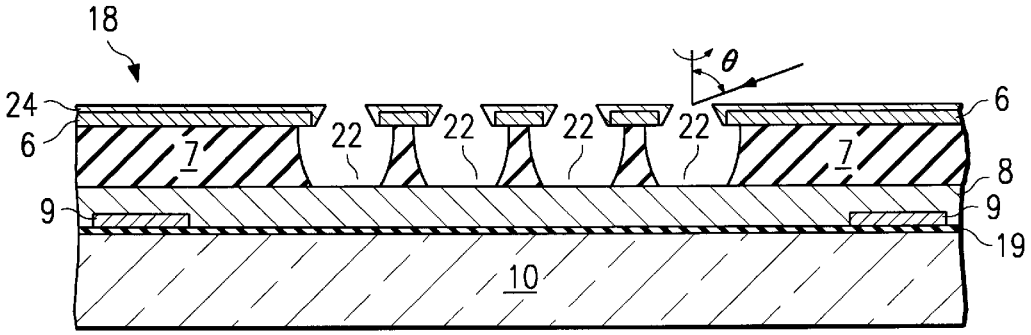

As shown in FIG. 6, a sacrificial lift-off layer 24 is formed by electron beam deposition over conductive coating 6 while rotating the substrate 10. The electron beam is directed at an angle of 5°–20 ° to the cathode plate surface (70°≧85° from normal) in order to also coat the circumferential aperture walls with lift-off material. The result of the plating process is a lift-off layer 24 which covers all exposed surfaces of the gate electrode 6, as shown in FIG. 6. The lift-off layer 24 is illustratively nickel, deposited to a thickness of 150 nm.

Figure 7:
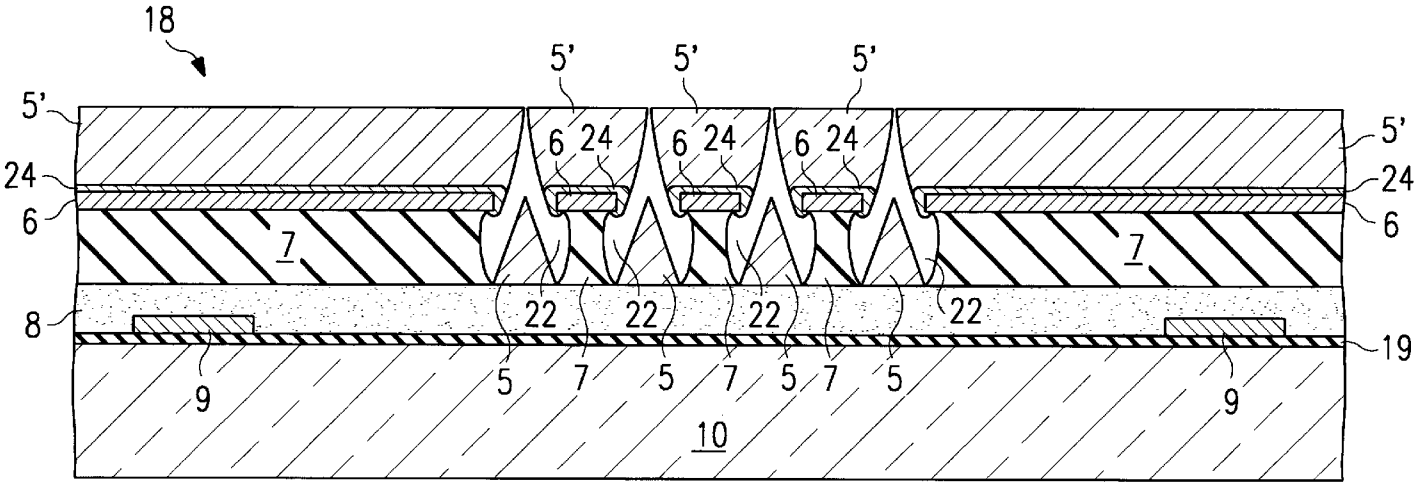
Figure 8:
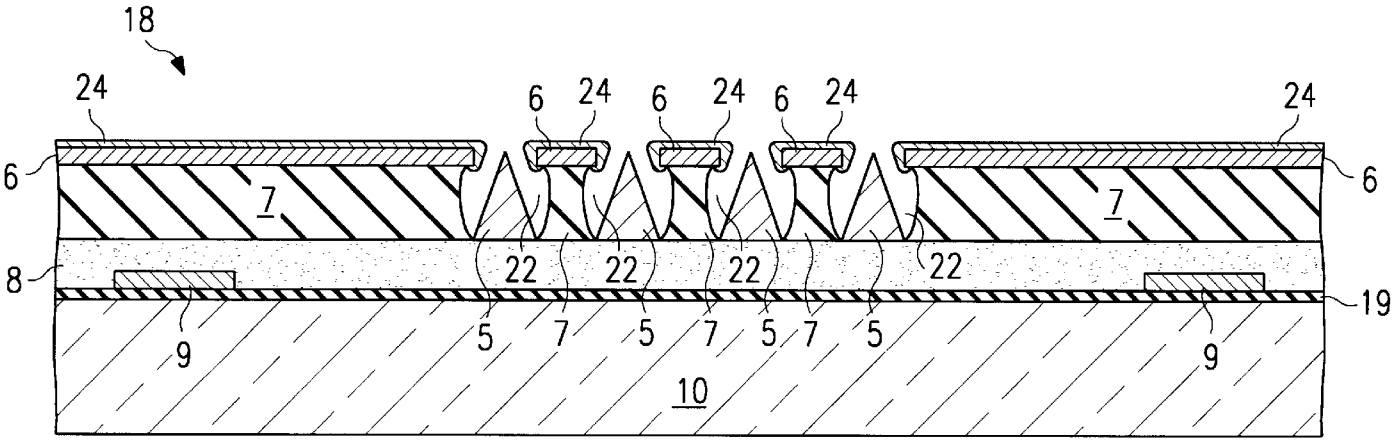
Figure 11:
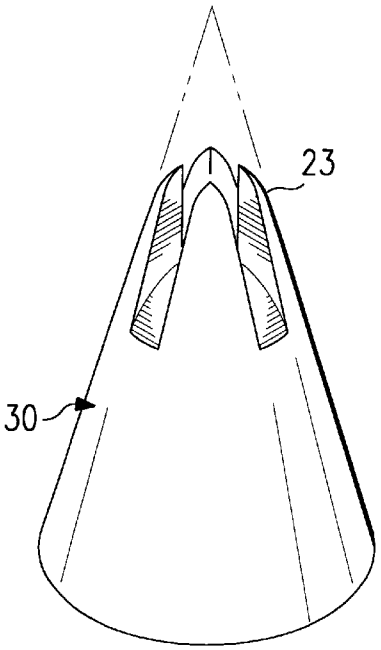
Figure 10:
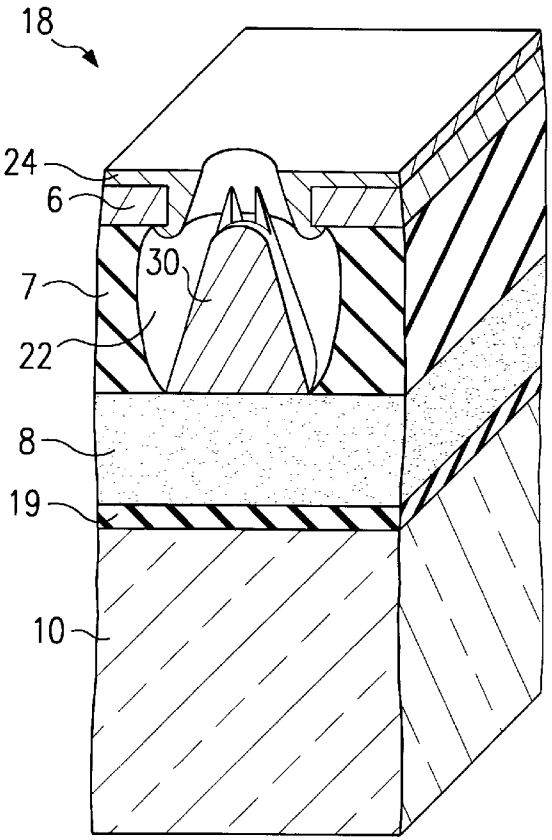

The next step in the manufacture of the emitter plate 18 is the formation of the microtip emitters 5, which may be as described in the Borel et al. ('161) patent. As shown in FIG. 7, the cone-shaped microtips 5 are deposited inside each cavity 22 by the deposition of a material coating, such as molybdenum, on the complete emitter structure 18 at a normal to slightly off-normal incidence. The result is the formation of pluralities of arrays of n×m microtips 5, which are in concentric alignment with the n×m apertures 22 of each aperture array. During the deposition process, the opening to aperture 22 narrows as the molybdenum coating simultaneously forms both the microtips 5 and the lift-off overburden 5'. The thickness of the microtips 5 is approximately 1.5 $\mu$. The lift-off overburden 5' is approximately 2.0$\mu$.

Alternatively, the microtip structures may be shaped as triangular or "knife-edged" structures. The above-mentioned article "Knife-edge thin film field emission cathodes on (110) silicon wafers," describes these structures and method of fabrication.

As discussed in the Spindt '704 patent, the sacrificial lift-off layer 24 is now dissolved by electrolytic etching. During the dissolution of the lift-off layer 24 the superfluous tip metal overburden 5' is also released, thereby creating the final cathode structure, shown in FIG. 8.

In accordance with the present invention, the microtips 5 are now modified to enhance their emission efficiency. Specifically, focused ion milling techniques are now used to modify the microtips 5. For example, focused ion milling machines, commonly used for analytical research, are used to emit a focused, chemically neutral beam toward the cathode plate 18 in a scanning motion. Illustratively, the chemically neutral ion beam is argon. The focused beam could be either a continuous beam or a pulsed beam.

Figure 9:
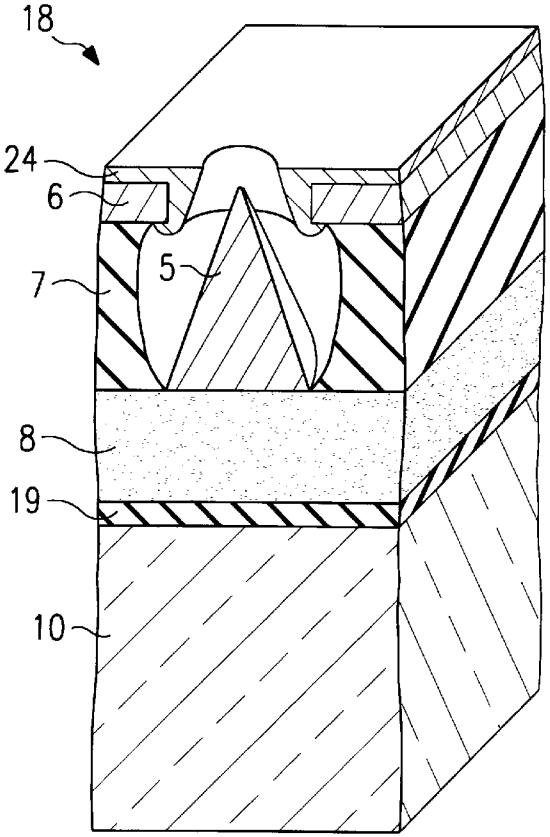

In a first illustrative embodiment, a continuous focused beam could be dragged across cathode plate 18 in a grid like manner; making two perpendicular cuts across microtip 5. If the microtip 5 has a conical shape after its initial fabrication, as shown in FIG. 9, the modified microtip 30 would look like FIG. 10 when viewed crosssectionally, and like FIG. 11 when viewed from an angle. The advantageous result of this process is multiple emission surfaces 23 having radii much smaller than the apex of the originally fabricated microtip 5. The reduced radii emission surfaces 23 greatly enhance the emission efficiency of microtip 30.

Figure 12:
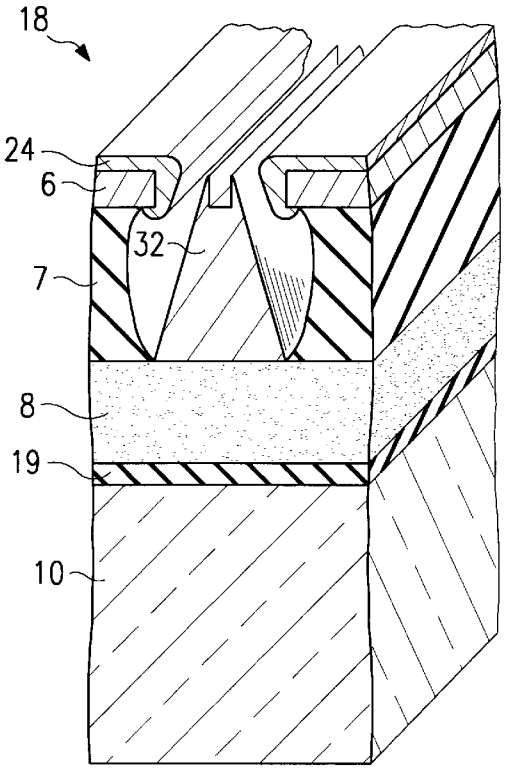
FIG. 12 is a cross-sectional view of a modified electron emission structure in accordance with another embodiment of the present invention.
Figure 13:
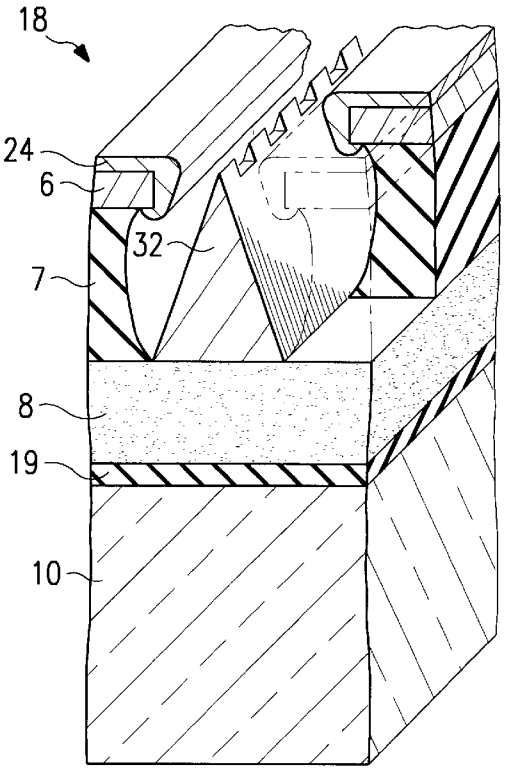
FIG. 13 is a cross-sectional view of a modified electron emission structure in accordance with another embodiment of the present invention.
Figure 14:
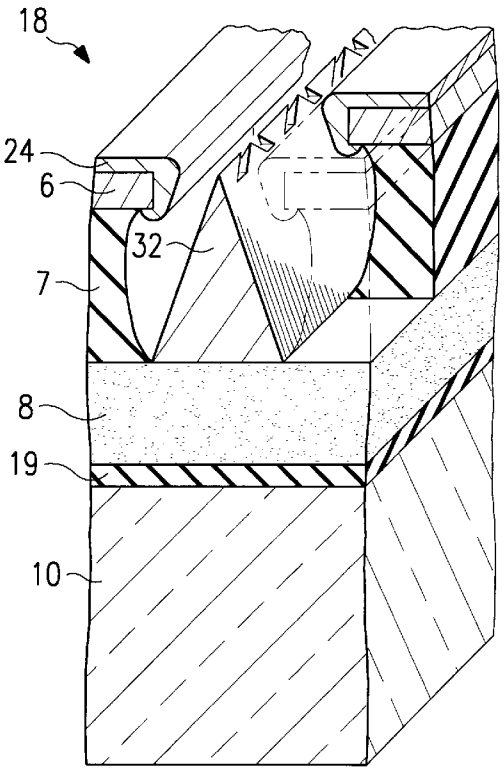
FIG. 14 is a cross-sectional view of a modified electron emission structure in accordance with another embodiment of the present invention.

In an alternative embodiment, dragging the continuous focused beam across a cathode plate having knife-edged emitters would result in emitter structures 32 having a double knife-edge apex, as shown in FIG. 12. Alternatively, the continuous focused beam could be dragged across cathode plate 18 perpendicular to the knife edge emitter structure. With this procedure, the resulting emitter structure would look like FIG. 13 for a beam normal to the cathode plate 18, and would look like FIG. 14 for a beam which is directed to cathode plate 18 at an angle.

Figure 16:
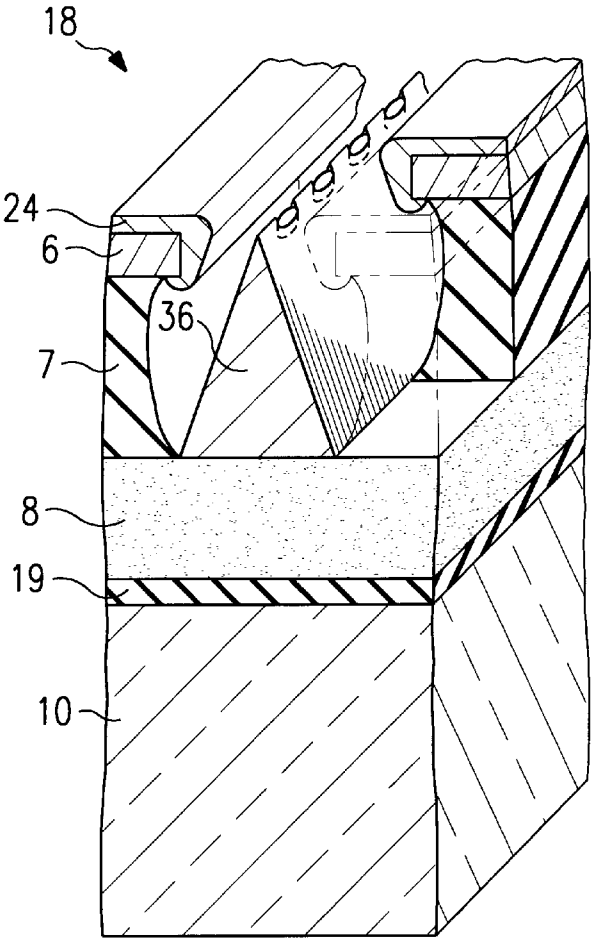
FIG. 16 is a cross-sectional view of a modified electron emission structure in accordance with another embodiment of the present invention.
Figure 15:
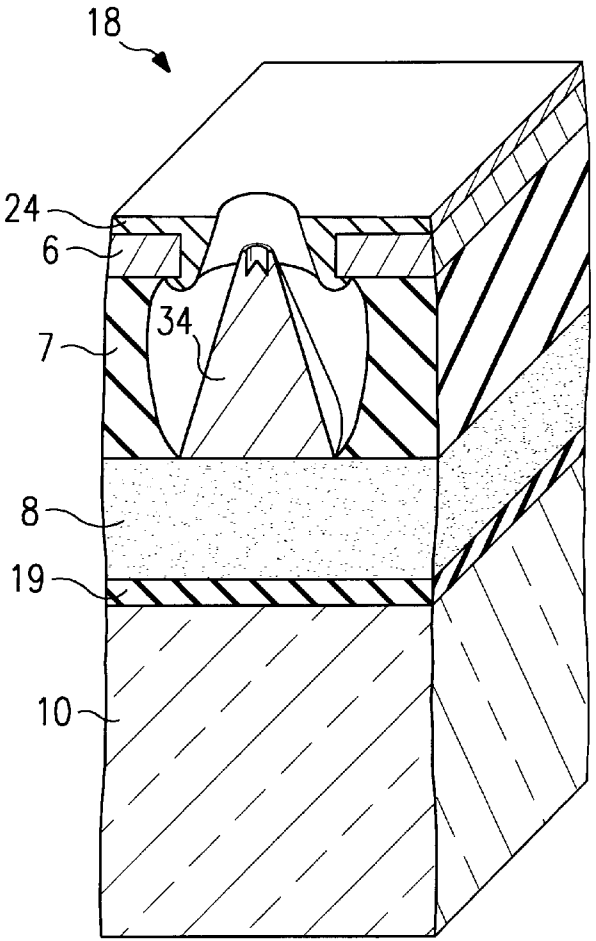
FIG. 15 is a cross-sectional view of a modified electron emission structure in accordance with another embodiment of the present invention.

In yet another illustrative embodiment, a pulsed focused ion beam is directed toward the apex of each microtip 5, resulting in a volcano shaped microtip 34, as shown in FIG. 15. This procedure will likely propagate the original tip profile to the bottom of the volcano. Similarly, as shown in FIG. 16, a pulsed focused ion beam directed to knife-edged structures would form circular voids in the knife-edged emitter structures 36.

Both the pulsed and the continuous focused ion beams referenced above could be a chemically neutral ion beam consisting of, for example, argon gas. Alternatively, both focused beams could be a chemically reactive beam consisting of $SF_6$, commonly referred to as a Reactive Ion Etch (RIE) beam. In addition, the beams could be a small radius laser beam, which would vaporize the microtip emitter structure material through electromagnetic radiation.

The dimensions of the various elements of FIGS. 9–16 are exaggerated and distorted in order to more clearly describe the invention; no true scaling information should be perceived therefrom. For example, the cuts shown in FIG. 10 made during the ion milling process are shallow. Specifically, the cuts are made such that the apex of the microtip does not fall substantially below the plane of the gate electrode 6 after the above described microtip modification process. It is important that the top of the modified microtips remain substantially coplanar with the plane of the gate electrode 6 because the electric field strength is greatest at the gate electrode 6. The highest possible electron emissions are realized when the apex of the microtip, which is the portion of the microtip where most of the electron emission occurs, is in the plane of the gate electrode 6.

Variations in the above process are considered to be within the scope of the present invention. For example, it may be desirable to coat the gate electrode with a lift-off layer, such as nickel, in order to prevent any removal of the gate electrode material during the microtip modification process. Also, removal of the gate material during the modification process could be reduced or eliminated by biasing the gate electrode negatively, while grounding the microtips. This would diffuse the strength of the focused beam as it crossed over the exposed gate material.

Several other variations in the above processes, such as would be understood by one skilled in the art to which it pertains, are considered to be within the scope of the present invention. First, a hard mask, such as aluminum or gold, may replace the photoresist layers of the above described process. Next, more than one material may be evaporated to form the microtips. Also, the microtips may be comprised of other materials or combinations of materials, such as niobium coated with any low work function material. In addition, the lift-off layer and overburden material may be removed by other procedures well known in the art, such as sonic bath, water spray, or air gun. Next, the focused beam may be pulsed by any method such as a mechanical shutter, or by electrical defocusing.

Other modifications of the above process within the scope of the invention include the angling of the focused beam to create microtip structures of other desirable shapes. Also, the microtip modification process may include many more abrading passes with the focused beam. Furthermore, the microtips may be modified by keeping the focused beam stationary while moving the cathode plate, or by keeping the cathode plate stationary while moving the focused beam, or even by moving both the focused beam and the cathode plate.

The methods disclosed herein for forming the enhanced emission microtips overcome limitations and disadvantages of the prior art display manufacturing methods. Specifically, this disclosed process can be used to modify microtips of any shape and material composition. Modifying the microtips to further reduce the radii of the sub-tips below microtip fabrication limits greatly improves the emission efficiency of the microtips. In addition, the advantageously described process for modifying the microtips is well understood; therefore, the microtips can be modified to realize enhanced emission efficiency without the time and expense of developing new manufacturing techniques.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

It is claimed:

1. A method of fabricating electron emission structures comprising the steps of:

providing a substrate having electron emission structures thereon and a gate layer over said electron emission structures;

modifying said electron emission structures with a focused beam; and wherein said focused beam comprises a focused ion milling beam and said ion milling is Reactive Ion Etch (RIE).

2. The method in accordance with claim 1 wherein said focused beam comprises a focused laser beam.

3. The method in accordance with claim 1 wherein said electron emission structures are conical and said modifying step includes passing said focused beam over said electron emission structures.

4. The method in accordance with claim 1 wherein said electron emission structures are conical and said modifying step includes pulsing said focused beam over said electron emission structures.

5. The method in accordance with claim 1 wherein said electron emission structures comprise an elongated wedge and said modifying step includes passing said focused beam over said elongated wedge.

6. The method in accordance with claim 1 wherein said electron emission structure comprises an elongated wedge and said modifying step includes pulsing said focused beam over said elongated wedge.

7. The method in accordance with claim 1 further including a step of applying negative voltage to said gate layer, prior to said modifying step.

8. The method in accordance with claim 1 further including a step of applying positive voltage to said electron emission structures, prior to said modifying step.

9. A method of fabricating an electron emission apparatus comprising the steps of:

forming a conductive layer on a substrate;

forming a parting layer on said conductive layer;

forming a plurality of apertures through said parting layer and said conductive layer;

removing said parting layer;

forming electron emission structures within said apertures;

modifying said electron emission structures with a focused beam; and wherein said focused beam comprises a focused laser beam.

10. A method of fabricating an electron emission apparatus comprising the steps of:

forming a conductive layer on a substrate;

forming a parting layer on said conductive layer;

forming a plurality of apertures through said parting layer and said conductive layer;

removing said parting layer;

forming electron emission structures within said apertures;

modifying said electron emission structures with a focused beam; and wherein said parting layer comprises titanium tungsten.

* * * * *